US007596330B2

(12) United States Patent
Oron et al.

(10) Patent No.: US 7,596,330 B2
(45) Date of Patent: Sep. 29, 2009

(54) DETERMINING A LOCATION OF AN UNCHARGED REGION ON A PHOTOCONDUCTIVE DRUM

(75) Inventors: Gadi Oron, Rehovot, IL (US); Boaz Tagansky, Rishon Letzion, IL (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 245 days.

(21) Appl. No.: 11/740,775

(22) Filed: Apr. 26, 2007

(65) Prior Publication Data

US 2008/0267646 A1 Oct. 30, 2008

(51) Int. Cl.
*G03G 15/00* (2006.01)
*G03G 15/02* (2006.01)

(52) U.S. Cl. ..... 399/48; 399/50; 399/160

(58) Field of Classification Search ..... 399/48, 399/162, 159, 50, 73, 160, 66, 302, 303, 399/308

See application file for complete search history.

(56) References Cited

U.S. PATENT DOCUMENTS 5,471,283 A * 11/1995 Irihara et al. ..... 399/308 X
5,963,761 A * 10/1999 Budnik et al. ..... 399/162
2005/0002681 A1* 1/2005 Takahashi et al. ..... 399/50
2007/0140714 A1* 6/2007 Kurita et al. ..... 399/48 X
2007/0166058 A1* 7/2007 Ohmori et al. ..... 399/26

* cited by examiner

*Primary Examiner*—Sophia S Chen

(57) ABSTRACT

A method for determining a location of an uncharged region on a photoconductive drum in an electrophotographic device, including rotating the photoconductive drum, and charging a surface of the drum via a charge roller by application of a voltage to the charge roller. An electrical characteristic of one of the charge roller or photoconductive drum is measured, and an alteration in the electrical characteristic is used to determine a location of the uncharged region.

13 Claims, 4 Drawing Sheets

DETERMINING A LOCATION OF AN UNCHARGED REGION ON A PHOTOCONDUCTIVE DRUM

The present invention relates to a method and device for determining a location of an uncharged region on a photoconductive drum.

An electrophotographic or liquid electrophotographic, LEP, process is utilized in a plurality of machines such as copying machines, facsimile machines, digital presses, and laser printers. As illustrated in FIG. 1, the process involves charging a surface of a photoconductor drum 10 with a charge roller 12, and exposing the charged surface of the drum to light produced by a modulated light source, 14, for example a laser, LED array or reflected light from an original document (in the case of an analogue document copier), to form an electrostatic latent image thereon. The latent images are developed by a developing unit 16 to create visible images, which are transferred to an intermediate transfer device 18 or directly to a sheet of media.

Some types of photoconductor drum comprise a seam or uncharged region. When implementing an electrophotographic or liquid electrophotographic, LEP, process with a photoconductor drum comprising a seam region, it is often desired to synchronize particular actions with a given angular location on the drum, for example, when changing the charging levels or activating a writing process.

A known method of determining a given angular location on the drum is to install an encoder on the rotating drum. However, this involves costly hardware and a calibration process to ensure the photoconductor drum conforms to strict tolerances. Even where such an encoder were available, it may not provide the accuracy of measurement required for some applications.

U.S. Pat. No. 7,102,661 discloses an apparatus comprising two laser systems and a photoconductive drum having a surface. Light beams projected from the laser systems overlap on the surface of the drum, thereby providing a reference mark. A position detection sensor is provided to detect the reference mark and activate its output at every revolution of the photoconductive drum. This enables actions requiring synchronization with the reference mark on the drum to be carried out. However, again, this involves costly hardware.

U.S. Pat. No. 7,116,922 discloses an apparatus comprising a photosensitive drum having a peripheral surface which is charged by a charge roller, to which a voltage is applied. The apparatus is further provided with a charge current measurement circuit for measuring the charge current that flows to the charge roller through the drum and a control circuit having a current detecting circuit for detecting current of a specific type. U.S. Pat. No. 7,116,922 is concerned with controlling the voltage source of the charge roller in such a manner that either AC voltage or DC voltage or both are applied to the charge roller, based on the charge current data determined from the charge current measurement circuit, in order to minimize the discharge between the drum and the roller while preventing the drum from being unsatisfactorily charged.

An embodiment of the invention will now be described, by way of example, with reference to the accompanying drawings, in which.

Figure 1:
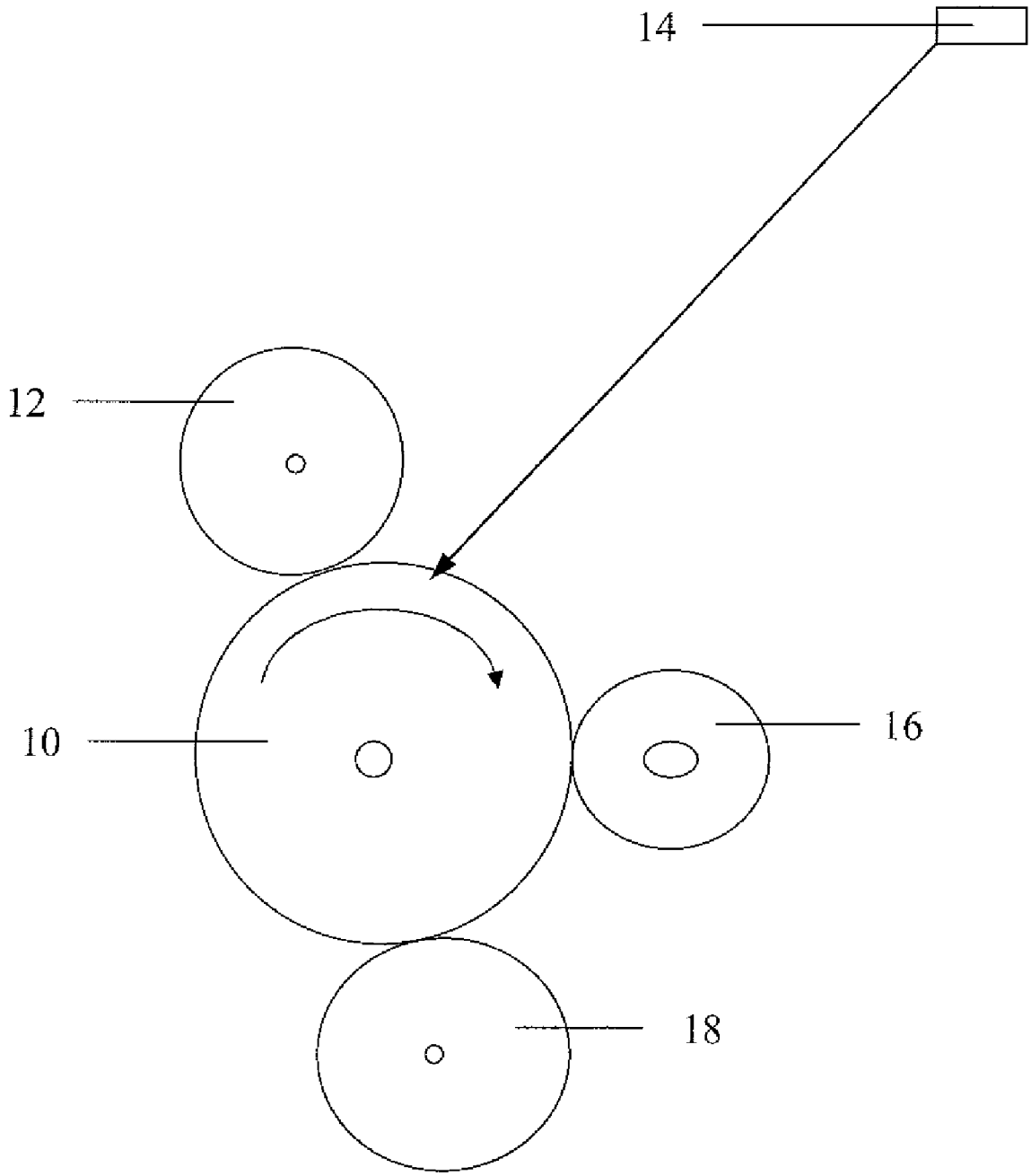
Figure 1 (Prior Art)
FIG. 1 illustrates a prior art electrophotographic device for implementing an electrophotographic process.
Figure 2:
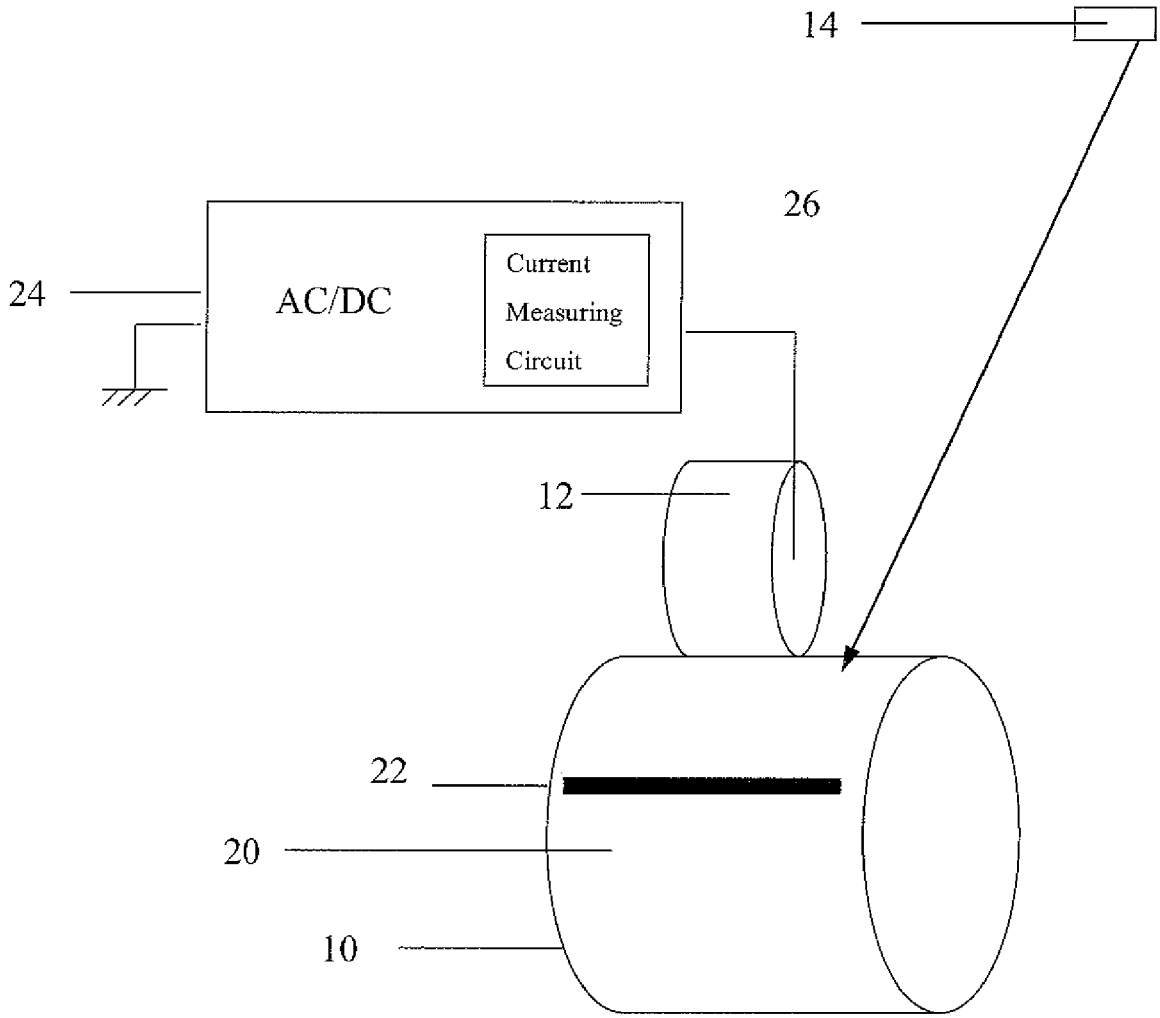
FIG. 2 illustrates an electrophotographic device for implementing an electrophotographic process according to an embodiment of the present invention.

Referring to FIG. 2, there is illustrated an electrophotographic device suitable for carrying out electrophotographic process according to an embodiment of the present invention. The device comprises a photoconductor drum 10, in contact with a charging roller 12. The drum 10 comprises a surface 20 with a seam region 22 provided thereon. A power supply 24 is provided for powering the charge roller 12.

By rotating the drum, preferably at a constant speed, and activating the charge roller 12 by applying a voltage to it, the surface 20 of the drum 10 becomes charged.

As explained above, it is often desirable to synchronize certain actions with an angular or temporal location of the drum 10. According to an embodiment of the present invention, synchronization is achieved by monitoring electrical characteristics of the charge roller 12 when applied to the drum 10. A particular alteration in the electrical characteristics can indicate the location of the seam, thereby enabling synchronization of further processes with the location of the seam to be achieved.

In an embodiment, the electrical characteristics of the charge roller 12 are monitored by means of a current measuring circuit 26 provided in the power supply. However it will be appreciated that the current measuring circuit 26 may be provided at any suitable location.

In a first embodiment, the charge roller 12 is activated by the application of voltages that fall within normal operating range suitable for charging the photoconductor drum 10. The DC charging current is then measured. This may be at a high sampling rate, for example, 16,264 Hz. For a normal drum rotation speed, this corresponds to an angular separation of 0.05° between samples on the drum 10. The results of the measurement are analysed to determine a change in the current value. This change in current reflects a change in the charging of the photoconductor drum 10, thereby indicating the seam region 22 of the drum 10. A wide range of sampling rates may be used in other embodiments, both of higher and lower frequency that 16,264 Hz.

It will be appreciated that generally the higher the sampling rate, the more accurate and precise a current profile produced. In one embodiment, the sampling rate is high enough to allow sufficient measurement of values during transition from an entry point of the seam region to the seam region and from an exit point of the seam region to the remainder of the drum. In embodiments with noisy signals, a higher sampling rate may be used.

In some embodiments, where the location of the seam is to be determined with a positional accuracy given by A (length) and the photoconductors tangential velocity is V (length/time), the sampling rate R (samples/time) may be selected so that $R \gg V/A$.

In alternative embodiments, the charge roller 12 is activated by the application of an AC voltage either alone or together with the DC voltage, the period of which is much lower than the temporal resolution required. In such an embodiment, the results of the measurement are analysed to determine a change in the current value. This change in current reflects a change in the charge roller 12 and/or photoconductor capacitance due to either a change in the geometry, for example, the distance between the charge roller 12 and the photoconductor, or the dielectric properties of the photoconductor in that region 22. When the current measuring circuit is implemented through a non-contact "current-clamp" technique that is more sensitive to AC than to DC, it is preferable to utilise an AC current.

In both the AC and DC embodiments, a drop in the magnitude of the current value from an average value indicates the point at which the charge roller 12 enters the seam region 22 of the drum 10, and a subsequent increase in the magnitude of the current towards its average level, indicates the point at which the charge roller 12 exits the seam region of the drum 10.

Figure 3:
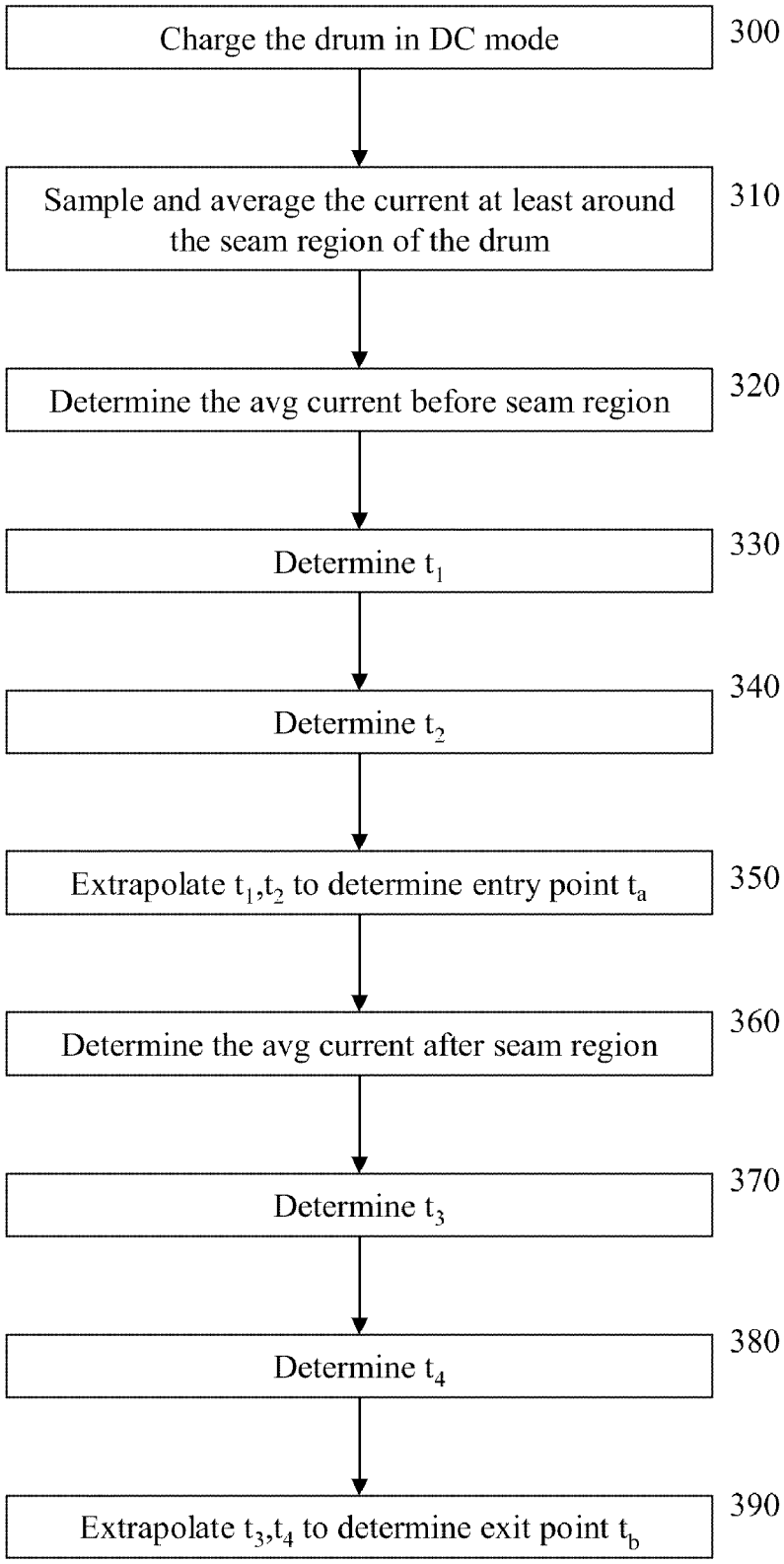
FIG. 3 is a flow chart depicting the processing performed in an embodiment of the present invention.

With reference to FIG. 3, a specific example of an application of the preferred embodiment of the present invention as implemented on a Hewlett-Packard Indigo Digital Press is provided.

Figure 4:
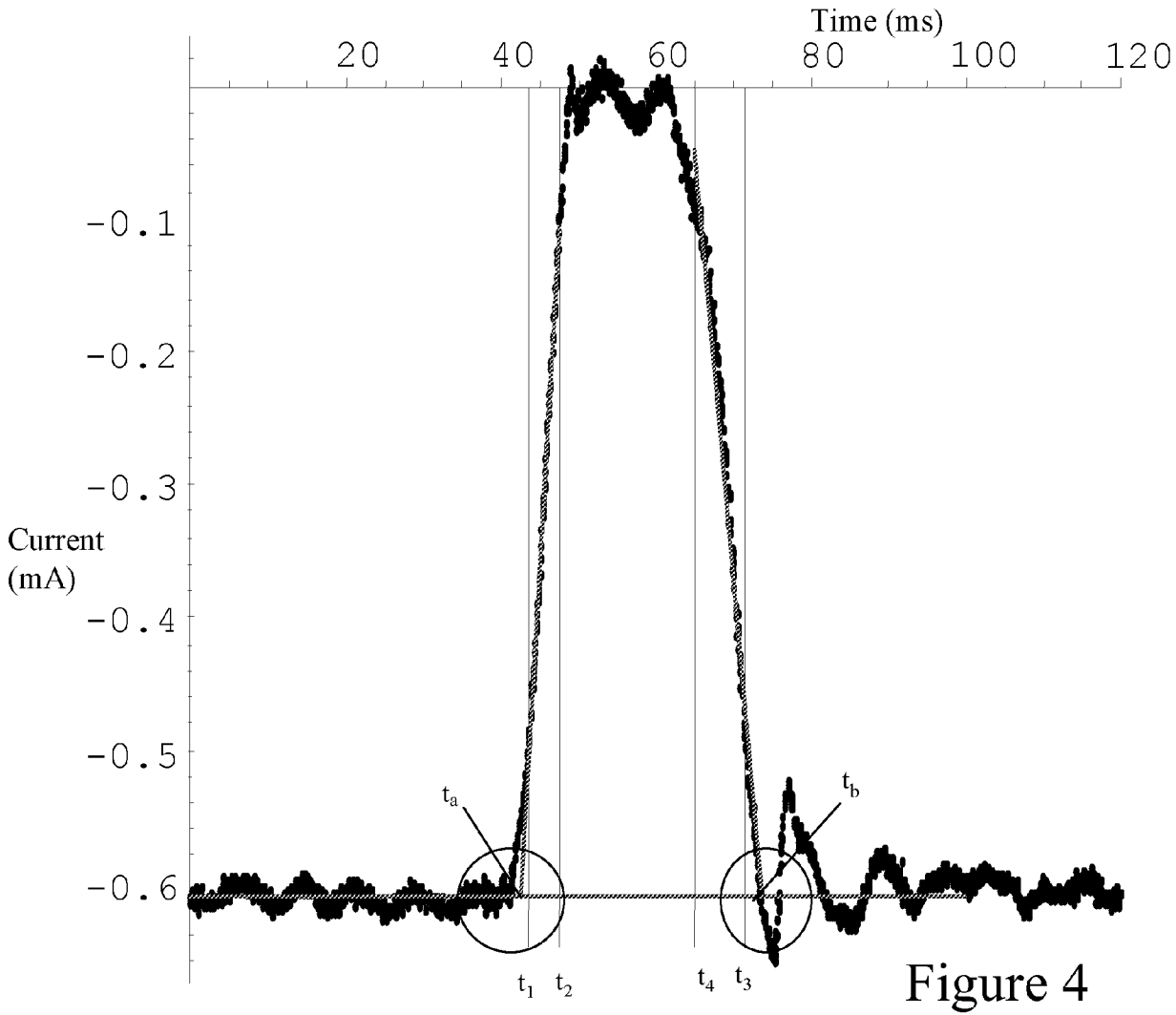
FIG. 4 depicts graphically current versus time measurements used in the processing of FIG. 3.

In this example, the drum 10 is charged 300 by the charging roller 12 in DC mode, as described above. The current of the charge roller (12) around the seam region 22 is sampled and averaged 310. This step may be repeated more than once, for example 2, 5, 10 or 20 times or more in order to improve the quality of the result with samples from each rotation being averaged. Correlation of the samples from one rotation to the next can be performed by any number of suitable techniques. FIG. 4 shows the results of this process graphically for the region around the seam.

From these measurements, the average current of the charge roller (12), before the seam region is determined, 320 and in the present example, this average is approximately −0.6 mA.

In step 330, the time $t_1$ when two consecutive current points have a magnitude less than 20% of the average current value from step 320 i.e. less then approximately −0.48 mA, is determined.

In step 340, the time $t_2$ after $t_1$ when two consecutive current points have a magnitude less than −0.1 mA is determined.

Extrapolating the times and current values at $t_1$ and $t_2$ provides a projected time $t_3$ when current is predicted to be the previously calculated average value, step 350. This time $t_a$ is deemed to be the entry point of the seam region 22.

A similar process is applied to determine the exit point of the seam region. Thus, the average current of the charge roller (12) after the seam is determined, 360.

In step 370, working backwards towards the entry point, the time $t_3$ when two consecutive current points have a magnitude less than 20% of the average current value from step 360 i.e. less then approximately −0.48 mA, is determined.

In step 380, the time $t_4$ before $t_3$ when two consecutive current points have a magnitude less than −0.1 mA is determined.

Extrapolating the times and current values at $t_3$ and $t_4$ provides a projected time $t_5$ when current is predicted to be the previously calculated average value, step 390. This time $t_b$ is deemed to be the exit point of the seam region 22.

In a variation of the above technique, the times and current values at $t_1$ and $t_2$; and $t_3$ and $t_4$ can be extrapolated to provide respective projected times when current is predicted to be 0.0 mA, and these times can be deemed to be more closely defined entry and exit points of the seam region 22.

Other variations of the measures taken above can also be used for defining seam exit and entry points, for example steps 370 and 380 can be reversed with their tests being for when points have magnitudes greater than −0.1 mA or 20% less than the average current value.

In an alternative embodiment, rather than calculating both the entry and exit points, determination of one of the entry point or exit point and knowledge of the size of the seam region 22 is used to estimate the other of the entry point or exit point of the seam region. In this embodiment, the other of the entry or exit point may be measured and determined for verification purposes.

In the particular cases of noisy signals, a further verification measure can be taken in all embodiments by comparing the entry and exit points of the seam with previously determined values, and rejecting these points if they are determined to be largely different. Furthermore, it should be ensured that the points fall within known limits of the system.

In the case of noisy signals, the determination of $t_1$, $t_2$, $t_3$ and $t_4$ can be improved be requiring that the threshold is crossed by more than one point. This assures that glitches in the signal will not cause a false trigger.

The current levels used to determine $t_1$, $t_2$, $t_3$ and $t_4$ may be adjusted according to the noise characteristics of the signal. If the noise level, defined as the standard deviation of the signal, is denoted as S, then the level change required, in certain embodiments, should be bigger than 3S but still low enough to allow a few dozens of measurement points to reside between $t_1$ and $t_2$ and between $t_3$ and $t_4$.

If a seam region has a complex structure and charging by the charge roller still occurs to some extent in the seam, the current characteristic might differ considerably from the one shown in FIG. 4. The seam location can be nonetheless determined using an pattern recognition technique from that of FIG. 3 and suitable to the current profile.

The method of the present invention is preferably carried out during a pre-print phase, as the processing overhead in sampling can be quite high and in general there tends to be little drift in the values determined for the seam location. However, it is appreciated that the method of the present invention may be carried out during a normal print process.

The invention is not limited to the embodiments described herein but can be amended or modified without departing from the scope of the present invention.

The invention claimed is:

1. A method for determining a location of an uncharged seam region on a photoconductive drum, the method comprising the steps of:

rotating the photoconductive drum;

charging a surface of the drum via a charge roller by application of a voltage to said charge roller;

measuring an electrical characteristic of said charge roller; and monitoring for an alteration in said electrical characteristic to determine a location of said uncharged seam region.

2. A method for determining a location of an uncharged region on a photoconductive drum, the method comprising the steps of:

rotating the photoconductive drum;

charging a surface of the drum via a charge roller by application of a voltage to said charge roller;

measuring an electrical characteristic of said charge roller, including sampling a current resulting from the application of the voltage; and monitoring for an alteration in said electrical characteristic to determine a location of said uncharged region.

3. The method according to claim 2 wherein said step of sampling is carried out for a plurality of rotations of said drum.

4. The method according to claim 3 wherein said step of sampling is carried out for at least two, at least five or at least ten rotations of said drum and wherein said method comprises the step of correlating the measurements for respective rotations of the drum to provide an average measurement of said characteristic for a rotation of said drum.

5. The method according to claim 2 comprising calculating an average value of current for a region of said drum.

6. The method of claim 5 wherein the region of said drum excludes said seam region.

7. The method of claim 5 wherein said monitoring comprises determining from a decrease in magnitude of the current value from said average value, a location of an entry point of said uncharged region of said drum.

8. The method of claim 5 wherein said monitoring comprises determining from an increase in magnitude of the current value towards said average value, a location of an exit point of said uncharged region of said drum.

9. The method of claim 5 wherein said determining comprises extrapolating from a first time when a current magnitude has a first value and a second time when said current magnitude has a second value to determine a time when said current magnitude has a third value as one of entry or exit points of said uncharged region.

10. The method of claim 9 wherein said third value is one of substantially zero current or said average value of current for said region of said drum.

11. A method for determining a location of an uncharged region on a photoconductive drum, the method comprising the steps of:

rotating the photoconductive drum;

charging a surface of the drum via a charge roller by application of a voltage to said charge roller;

measuring an electrical characteristic of said charge roller;

monitoring for an alteration in said electrical characteristic to determine a location of said uncharged region; and determining one of an exit and an entry point of said uncharged region of said drum from a measurement of the other of said exit and said entry point of said uncharged region and a pre-determined measurement of said uncharged region.

12. An electrophotographic device comprising:

a rotatable photoconductive drum;

a charge roller coupled to an electrical source for charging a surface of the drum via said charge roller;

a meter for measuring an electrical characteristic of said charge roller; and means for monitoring for an alteration in said electrical characteristic to determine a location of a seam region.

13. A device as claimed in claim 12 wherein said electrical source is arranged to supply one or more of an AC voltage or a DC voltage.

* * * * *